US006442354B1

(12) United States Patent
Friedrich et al.

(10) Patent No.: US 6,442,354 B1
(45) Date of Patent: Aug. 27, 2002

(54) SCAVENGER PLATE MONITORING SYSTEM

(75) Inventors: Kenneth P. Friedrich, Honeoye; Laverne N. Lincoln, Jr., Macedon, both of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/822,569

(22) Filed: Mar. 30, 2001

(51) Int. Cl.[7] ..... G03G 21/00; G03G 15/08
(52) U.S. Cl. ..... 399/37; 399/264; 399/283
(58) Field of Search ..... 399/9, 37, 88, 399/129, 264, 265, 266, 270, 273, 283

(56) References Cited

U.S. PATENT DOCUMENTS 5,047,807 A * 9/1991 Kalyandurg ..... 399/264
5,184,194 A * 2/1993 Mosenhauer et al. ..... 399/279

* cited by examiner

*Primary Examiner*—Sophia S. Chen

(57) ABSTRACT

A protection circuit for an electrophotographic image-forming apparatus is disclosed. The protection circuit monitors the operational state between the power supply and scavenger plate of the electrophotographic image-forming apparatus and issues an interrupt signal whenever a de-coupled state is sensed.

5 Claims, 3 Drawing Sheets

PRIOR ART

SCAVENGER PLATE MONITORING SYSTEM

BACKGROUND OF THE INVENTION

The present invention relates generally to an electrophotographic image-printing apparatus or machine, also commonly known as a xerographic printing apparatus, and more particularly to an improved protection circuit for monitoring the operational state of an internal scavenger plate of an electrophotographic image-printing system.

The function of the scavenger plate in a conventional electrophotographic image-printing apparatus is well known. Toner and carrier particles are mixed in a developer station or sump. The mixture (typically toner particles carried by positively charged carrier particles) is mechanically withdrawn from the sump and deposited on a toning roller, magnetically held thereon. The toning roller passes in close proximity with an image loop or photoconductor, such that the toner particles are transferred thereto in a pattern corresponding with the image to be printed (usually represented by negative charges on the image loop).

The majority of carrier particles remain on or fall back upon the toning roller. As the toning roller continues to rotate, the carrier particles, lacking toner particles, are re-deposited in the developer sump for toner replenishment.

Unfortunately, carrier particles also accumulate on the image loop. The scavenger plate interposes the toning roller and image loop, and the electrical bias on the scavenger plate draws those carrier particles off the image loop. Once released from the image loop, the carrier particles are returned to the toning roller and/or developer sump.

Failure of the scavenger plate, for whatever reason, may have severe consequences. First, carrier accumulating on the image loop may adversely affect print quality; upon release from the image loop, the carrier particles may be transferred to other rollers or the imaged paper. Second, released carrier may infiltrate other components within the electrophotographic image-printing system, causing failure. Third, accumulation rapidly depletes the supply of carrier within the developer station, interfering with the ability to control toner concentration.

Several conventional electrophotographic image-printing apparatus are shown in U.S. Pat. Nos. 4,647,186; 5,047,807; 5,184,194; and 5,715,503. The teachings thereof are fully incorporated herein by reference.

SUMMARY OF THE INVENTION

In a principal aspect, the present invention is a protection circuit for an electrophotographic image-printing apparatus having an internal scavenger plate biased by a power supply in a coupled state. The protection circuit monitors the coupled state and issues an interrupt signal whenever the coupled state is lost or absent. The protection circuit represents an improvement over conventional electrophotographic printing systems wherein an interrupt signal is provided only in response to an arc or an electrical short between the scavenger plate and the system housing.

It is thus an object of the present invention to provide a circuit for determining whether a power supply and scavenger plate of an electrophotographic image-printing apparatus are properly coupled. Another object is a protection circuit, coupled to a scavenger plate of an electrophotographic image-printing apparatus, for sensing the presence of a power cable or a bias voltage at the scavenger plate.

These and other features, objects and advantages of the present invention are described or implicit in the following detailed description of certain preferred embodiments.

BRIEF DESCRIPTION OF THE DRAWING

Various preferred embodiments of the present invention are described herein with reference to the drawing wherein.

DETAILED DESCRIPTION OF VARIOUS PREFERRED EMBODIMENTS

Figure 1:
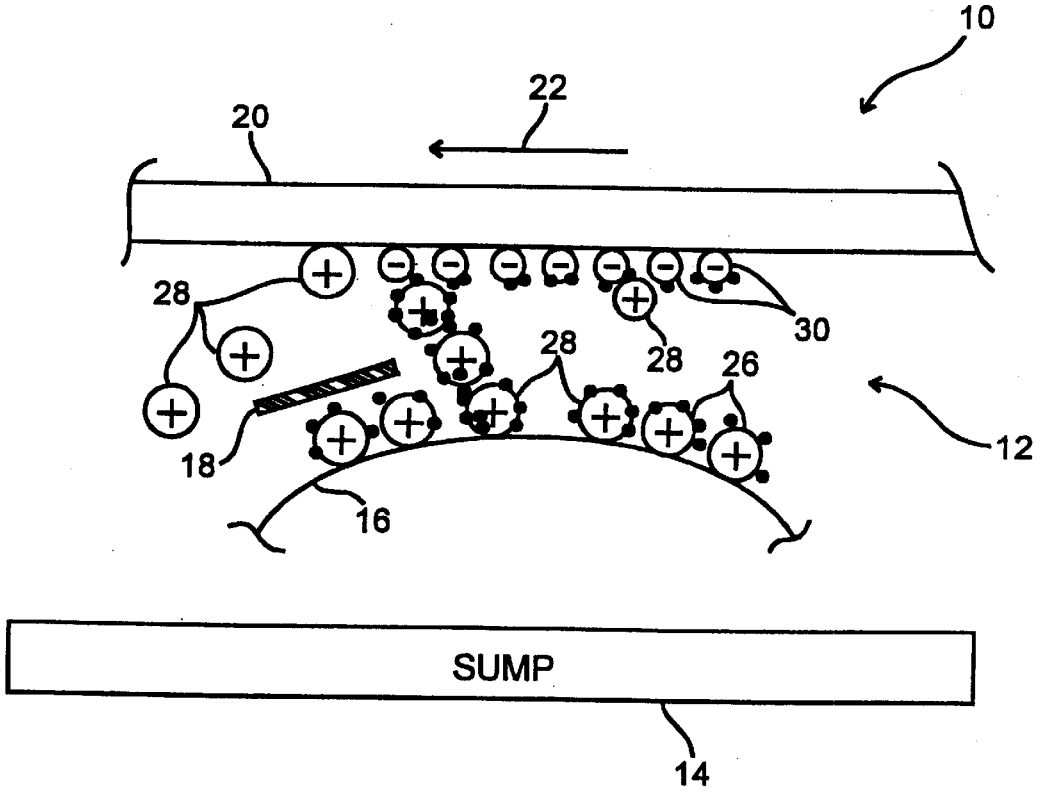
FIG. 1 is a partial schematic diagram of a conventional electrophotographic image-printing apparatus.
Figure 2:
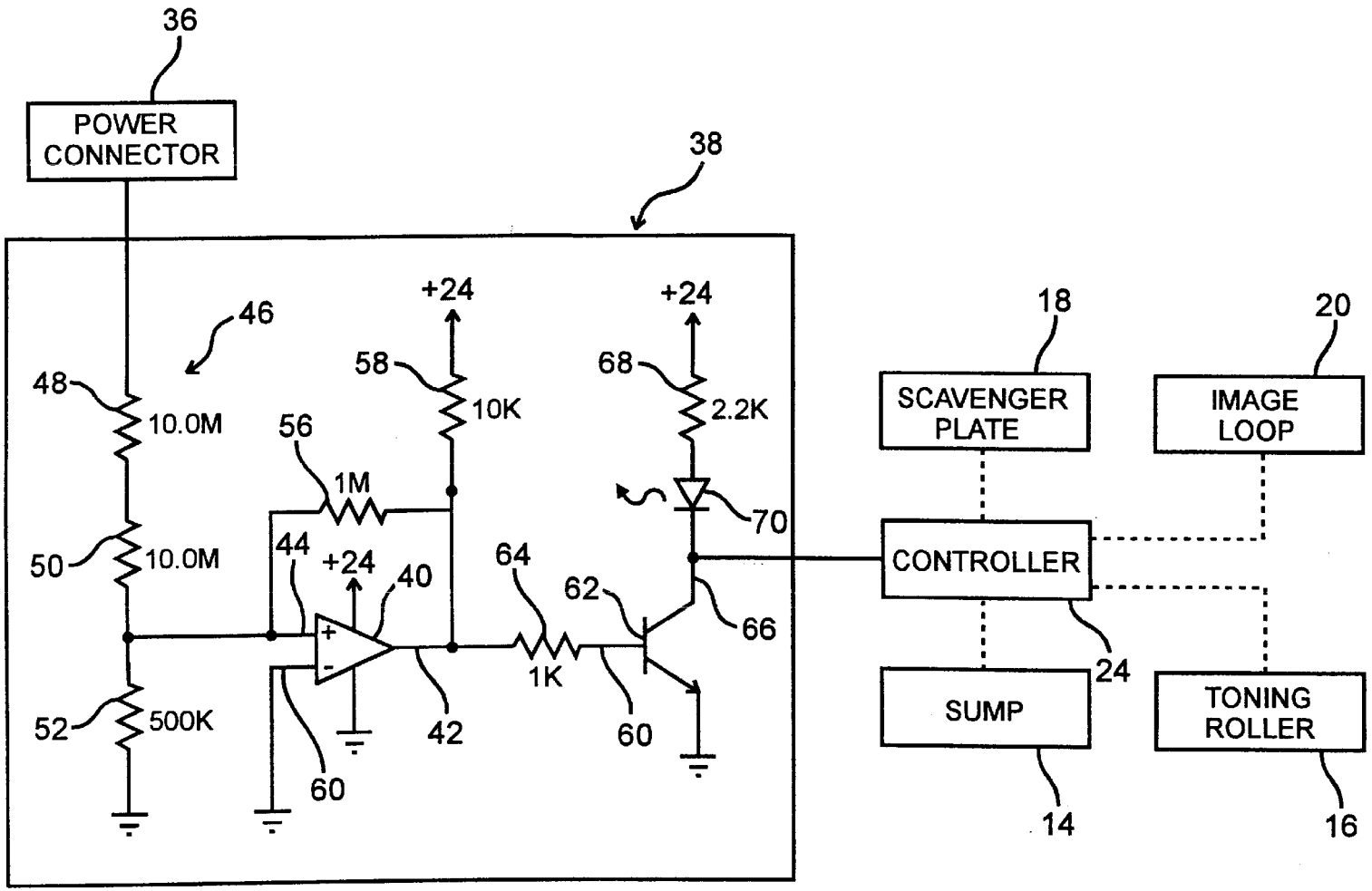
FIG. 2 is a schematic diagram illustrating a first preferred embodiment of the present invention.

With reference first to FIG. 1 (drawing is not to scale in order to better depict operation), a conventional electrophotographic image-printing apparatus, generally designated 10, is shown schematically. The apparatus 10 has a toning station or area, generally designated 12, including a developer sump 14, a toning roller 16 (including a conventional counterclockwise rotating roller shell and clockwise rotating magnetic core, not shown) and a scavenger plate 18. An image loop 20 passes through the toning station 12 (in the direction of arrow 22), and the scavenger plate 18 generally interposes the toning roller 16 and image loop 20. As best shown in FIG. 2, the sump 14, toning roller 16, scavenger plate 18 and image loop 20 all operate conventionally under the direction of a controller or processor 24.

As is well known in the art, toner particles 26 are mixed with and electrostatically bound to carrier particles 28 in the sump 14. The combined particles 26, 28 are deposited on and carried by the toning roller 16. As the roller 16 passes adjacent to the image loop 20, the toner particles 26 are electrostatically transferred thereto. As shown in FIG. 1, the image to be printed is illustrated as negative charges 30 (to which the toner particles 26 adhere) on the image loop 20. In this operation, unwanted carrier particles 28 accumulate on the image loop 20.

The scavenger plate 18 attracts excessive carrier particles 28, accumulating on the image loop 20, for re-deposit onto the toning roller 16 and/or directly into the developer sump 14. The scavenger plate 18 is provided with a biasing voltage from a power supply 32. In this preferred embodiment, the biasing voltage is the combination of a negative 900 volt offset and a 600 Hz, 1200 volt (peak-to-peak) signal.

Figure 3:
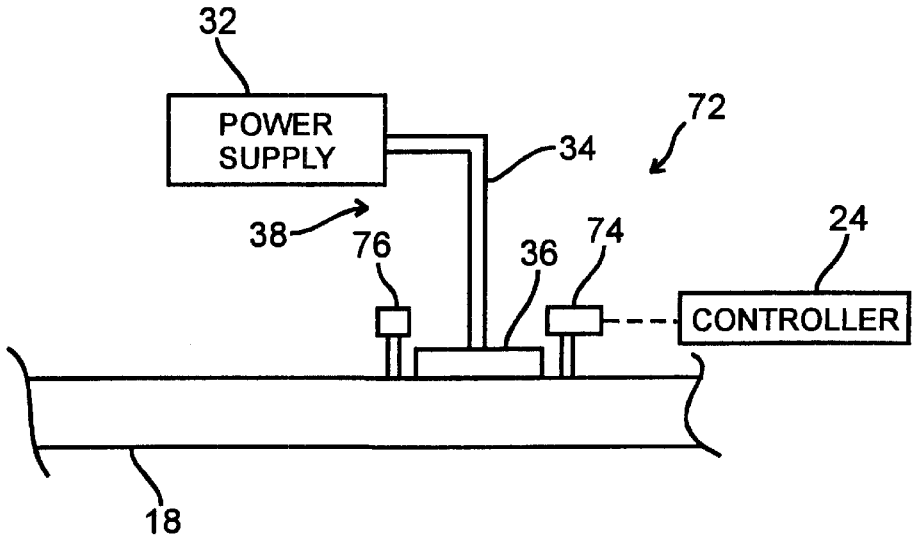
FIG. 3 is a schematic diagram illustrating a second preferred embodiment of the present invention.

As best shown in FIG. 3, this bias is provided to the scavenger plate 18 through a power cable 34, coupling the scavenger plate 18 and the supply 32. In the coupled state, the cable 34 engages and interlocks with a power connector or harness 36, attached to the scavenger plate 18, delivering the biasing voltage at the power connector 36.

Referring now to FIGS. 1–4, the present invention is shown as an improved protection system, generally designated 38, for monitoring the coupled state, i.e., whether the bias voltage and/or the power cable 34 is present at the power connector 36. In the preferred embodiment of FIG. 2, the coupled state is monitored through a determination as to whether the biasing voltage is present at the power connector 36; in the preferred embodiment of FIG. 3, the coupled state is monitored through a determination as to whether the power cable 34 physically engages the power connector 36. The protection circuit 38 issues an interrupt signal to the controller 24 whenever the electrophotographic system 10 is operative and the coupled state is absent or lost. The controller 24 responsively discontinues operation of the system 10, except for conventional diagnostics.

With particular reference now to FIG. 2, the protection circuit 38 includes a comparator 40, having an output terminal 42. A first, positive input terminal 44 of the comparator 40 is connected to the power connector 36 through a first voltage divider, generally designated 46, including resistors 48, 50, 52 interconnected as shown. A second, negative input terminal 60 of the comparator 40 is grounded.

The output terminal 42 is interconnected to the positive input terminal 44 through a feedback resistor 56 and to power through a resistor 58, as shown. The output terminal 42 is also interconnected to the base 60 of a transistor 62, through a coupling resistor 64. The collector 66 of the transistor 62 is connected to the controller 24 and to power through a resistor 68 and a light-emitting diode 70, as shown.

Whenever the coupled state is absent, i.e., whenever there is no bias voltage at the power connector 36, the output terminal 42 of the comparator 40 is pulled high and the transistor 62 conducts. As such, the protection circuit 38 issues a "0" signal to the controller 24 and the diode 70 is illuminated. More particularly, the protection circuit 38 causes an interrupt "0" to be issued whenever the bias voltage is not present at the power connector 36, regardless of cause. One such cause would be a failure of the power supply 32; another would be disengagement of the power cable 34 from the power connector 36. The diode 70 facilitates identification of the needed repair or servicing.

Figure 4:
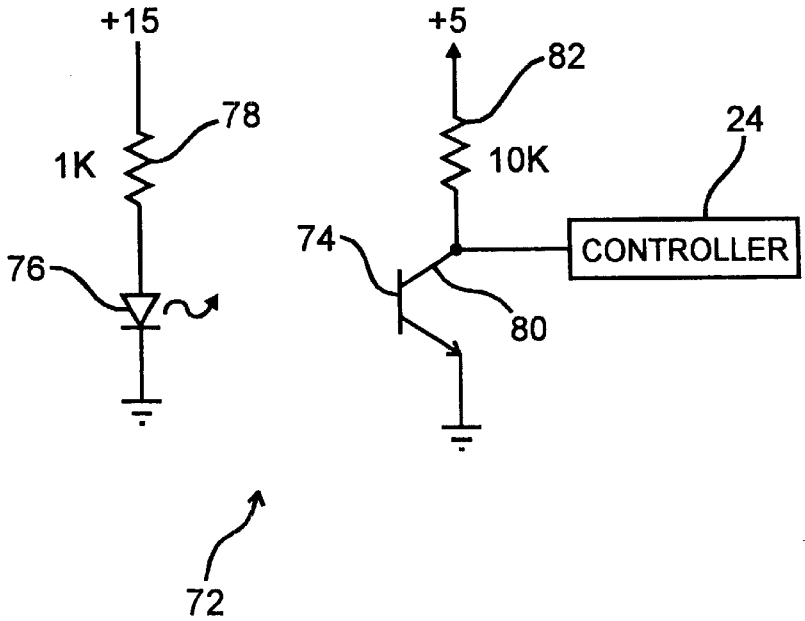
FIG. 4 is a schematic diagram further illustrating the second preferred embodiment of FIG. 3.

Referring now to FIGS. 3 and 4, which illustrate a second preferred embodiment of the present invention, the protection circuit 38 includes an optical circuit, generally designated 72, for sensing attachment of the power cable 34 to the power connector 36. The optical circuit 72 includes a phototransistor 74 and an opposed, light-emitting diode 76, powered whenever the image-printing apparatus 10 is operative. Whenever the power cable 34 is attached, the optical link between the phototransistor 74 and LED 76 is broken, indicating that the coupled state is present. Whenever the optical link is established, i.e., whenever the coupled state is absent, the protection circuit 38 issues the interrupt signal to the controller 24.

As shown in FIG. 4, the LED 76 is connected to power through a resistor 78. The collector 80 of the phototransistor 74 is connected to the controller 24 and to power through a resistor 82. Whenever there is an optical link between the phototransistor 74 and LED 76, the controller 24 receives an interrupt "0" signal.

Preferred embodiments of the present invention have been described in detail. It is to be understood, however, that changes and modifications can be made without departing from the true scope and spirit of the invention as defined by the following claims, which are to be construed and interpreted in view of the foregoing. For example, any circuit capable of sensing the presence of the biasing voltage at the power connector 36 is suitable; similarly, any circuit capable of sensing the presence of the power cable 34 at the power connector 36 is sufficient.

What is claimed is:

1. In an electrophotographic image-forming apparatus having a power supply and a scavenger plate, said scavenger plate receiving a bias voltage from said power supply in a coupled state, the improvement comprising:

protection means for monitoring said coupled state and for issuing an interrupt signal whenever said electrophotographic image-forming apparatus is operative and said coupled state is absent.

2. The improvement of claim 1 wherein said electrophotographic image-forming apparatus further includes a power cable interposed said power supply and a plate connector on said scavenger plate, said protection means monitoring said coupled state at said plate connector.

3. The improvement of claim 2 when said protection means senses said bias voltage at said plate connector and issues said interrupt signal whenever said bias voltage is absent.

4. The improvement of claim 3 wherein said protection means includes a comparator coupled to said plate connector.

5. The improvement of claim 2 wherein said protection means includes optical means for sensing an attachment of said power cable to said plate connector and issuing said interrupt signal whenever said attachment is absent.

* * * * *